US006371311B1

(12) United States Patent
Barrett et al.

(10) Patent No.: US 6,371,311 B1
(45) Date of Patent: Apr. 16, 2002

(54) RACK FOR STORING PRODUCT

(75) Inventors: Ricklef E. Barrett; Steven C. Thompson, both of Elkhart, IN (US); Martin L. De Land, Corona; Steven T. D. Oatman, Mission Viejo, both of CA (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/612,731

(22) Filed: Jul. 10, 2000

(51) Int. Cl.[7] ..... A47F 5/00

(52) U.S. Cl. ..... 211/59.2; 211/162; 211/205; 280/79.3

(58) Field of Search ..... 211/163, 59.2, 211/59.1, 162, 196, 205; 280/79.3; 312/60

(56) References Cited

U.S. PATENT DOCUMENTS 2,299,403 A * 10/1942 Mozel
2,729,914 A * 1/1956 Cook
D182,448 S * 4/1958 Theisen
2,841,901 A * 7/1958 Maple
4,120,501 A * 10/1978 Atherton
4,175,665 A * 11/1979 Dogliotti ..... 211/59.2
5,336,536 A * 8/1994 Oberzan ..... 211/196 X
5,405,662 A * 4/1995 Oberzan ..... 211/196 X
5,865,324 A * 2/1999 Jay et al. ..... 211/59.2
5,975,317 A * 11/1999 Roebling ..... 211/196
6,056,152 A * 5/2000 Gonzalez

* cited by examiner

*Primary Examiner*—Robert W. Gibson, Jr.
(74) *Attorney, Agent, or Firm*—Michael Best & Friedrich LLC

(57) ABSTRACT

A rack is provided having a track which is adapted to removably support a plurality of items in a predetermined pattern or order. The track comprises a plurality of interconnected levels so that the items may move along the track between the different levels and the items are readily accessible from all locations on the track. Clips may be used to sectionalize the rack and to balance the load on the rack while it spins.

31 Claims, 5 Drawing Sheets

RACK FOR STORING PRODUCT

FIELD OF THE INVENTION

This invention relates primarily—but not exclusively—to spinner racks and more particularly to racks for storing or inventorying products or items such as prescription refills in an ordered system

BACKGROUND OF THE INVENTION

Display and storage racks commonly available provide a variety of configurations in which to present products for sale or to store or otherwise inventory items for later use. Typically, such racks either display or store items in a linear or circular manner. For example, gondolas and similar shelving systems found in many retail stores provide a plurality of horizontal shelves and other types of display devices such as brackets and rods which can be hung from a central support and ;on which product can be displayed. Such known displays are illustrated, for example, in U.S. Pat. Nos. 5,697,507; 4,919,282; 4,046,083; and 2,965,242. Similarly, circular rods supported by a center mast or structure and from which clothing or similar items are hung can be found in many retail stores. Such racks, however, do not satisfactorily meet the needs found in a variety of situations where it is necessary or desirable to display items in an ordered pattern wherein the items are easily accessible and readily viewable from all sides of the rack, and inventory control is also desired.

In many other situations items such as prescription refills, photographs developed for consumers by a commercial establishment, or medical records, to name but a few, need to be stored in an ordered manner sol that particular orders or records may be quickly located and retrieved for presentment to a customer or for use in attending to a patient. Typically, such items are stored in bins, drawers or filing cabinets which are labeled in some sort of systematic manner, such as alphabetically or by special code, so that each particular item can be located and retrieved as required. Nonetheless, such systems can prove to be cumbersome or time-consuming to use. When a large number of items are stored together in one bin or drawer, it can be rather time-consuming to sort through the bin to find a particular item. As items are removed from the bin or drawer and new items added, the bin may become cluttered and it can prove difficult to keep the bin organized. Consequently, locating and retrieving a particular item stored within a crowded bin or drawer becomes more difficult and time-consuming. Also, such bins and drawers often take up an inordinate amount of space, are expensive to construct and install, and may present an unsightly, disheveled appearance to customers.

Pharmacies present an example where it is desirable to prepare and store large numbers of unique items for later individualized retrieval. Many people are on programmed prescription drugs, medicines, flood supplements, and the like (hereinafter collectively called "medications") which require taking a number of such medications on a timed schedule. As a result, pharmacies can easily predict within a few days when a customer will call for a refill of his medication. The advent of the computer has made the record keeping and prediction for such refills easier to maintain.

On the other hand, a pharmacy staff does not always have a smooth flow of work which can be done in an orderly manner. During normal working hours of a day, many customers are at their place of employment and the pharmacy staff has slack time with only a few customers to serve. On weekends and in the evening hours after the workday ends, there is a flood of people simultaneously demanding service. The pharmacy cannot afford to staff many people when demand is slack. If the staff has too few people when demand is strong, the customers may go elsewhere.

A further complication is that once a prescription is filled, it is generally placed in one of many baskets marked alphabetically. When a customer comes in to pick up his prescription or other medication, the pharmacy staff usually looks through a basket carrying the customer's initials. Many times, the pressure of the rush hour leads to placing the prescriptions or medications in the wrong basket. Therefore, the usual procedure is to look through a number of baskets if the prescription is not found at the expected location. These and similar problems often create significant ill will among the customers of a pharmacy and take up unnecessary time of the pharmacy staff.

A desirable procedure would be for the pharmacy staff to use slack time calling up and filling the soon-to-be-ordered prescriptions or medications and filling them. Then, when the customer comes in for a refill, the pharmacy staff simply hands the customer the pre-filled container. This procedure creates a problem of controlling the inventory of pre-filled containers.

Thus, there is a need for a rack which provides a system or method to inventory a plurality of unique items such as pre-filled prescriptions in a predetermined order. Such a rack should allow for items to be added to and removed from the rack without disturbing the systematic order in which the items are stored. The present invention provides such a rack and system, which is particularly suitable for use in storing and inventorying unique items, such as prescription refills, processed film envelopes, and medical records in an ordered system for quick and easy retrieval.

SUMMARY OF THE INVENTION

Accordingly, an object of the invention is to provide a general-purpose system which can be used for filing any appropriate item within an ordered inventory of such items, thereby providing ready access to specific individual items within the ordered inventory. According to the present invention, the ordered inventory is easily maintained as items are added to and removed from the system in locations consistent with the method employed for ordering the inventory. Yet another object is to provide a rack with a plurality of interconnected levels for the point-of-sale display of products in a retail environment, the rack not only being attractive, but also serving to manage the inventory of products in a systematic manner.

A first example of where the present invention may be useful is in a retail pharmacy setting. Pre-filled prescription orders may be placed on the rack system of the present invention in some systematic order, such as alphabetically by customer name, order number, or some other method of uniquely identifying and organizing each prescription order. As customers arrive to pickup their prescriptions, the proper pre-filled order may be easily located based on the order's unique identifier and the ordered system for storing the prescriptions on the rack. The rack system is such that when individual pre-filled prescription orders are removed, the overall order of the inventory is maintained, so that the pre-filled prescription orders remaining on the rack may be similarly easily located for fast, efficient retrieval and later prepared orders may be systematically stored on the rack.

Another example where the present invention could find use is in the storage and inventorying of processed photographs prepared by commercial film developers for pickup by customers. Photographs developed by commercial processors are usually packaged in envelopes bearing a unique identifier such as a numbered code or a customer's last name, in much the same way that pre-filled prescription orders are packaged. The present invention provides a system uniquely adapted for holding the developed photographs in an ordered system wherein the photographs can be quickly and easily located and retrieved for customer pickup.

The present invention also provides a rack with multiple interconnected levels for the display of product in a unique configuration so that. the product is exposed to view as it moves along the different levels of the rack. Such display racks may be suitable for any number of different retail environments where it is desirable to make a relatively large number of items stored in a pre-determined order or according to a pre-defined system readily available for consumer viewing and access, and which facilitates inventory control.

In keeping with an aspect of the invention, a rack is provided with a track having several interconnected levels to support a variety of different types of products or items. The track may be supported by a center mast or other type of structure, or in appropriate circumstances, freestanding. Means are provided to removably support the product or items on the track so that they can move along the track between the different track levels. In some applications, the product or items may be labeled with a unique identifier so that they can be placed on the rack in a predetermined ordered inventory or system. As items are removed and added to the rack, the predetermined order is maintained. The rack may be rotatable—i.e. a "spinner"—to permit easy access to the stored products or items at all locations along the multi-level track.

BRIEF DESCRIPTION OF THE DRAWINGS

A preferred embodiment will be understood best from a study of the following specification, taken with the attached drawings, in which.

DETAILED DESCRIPTION OF THE MENTION

Figure 1:
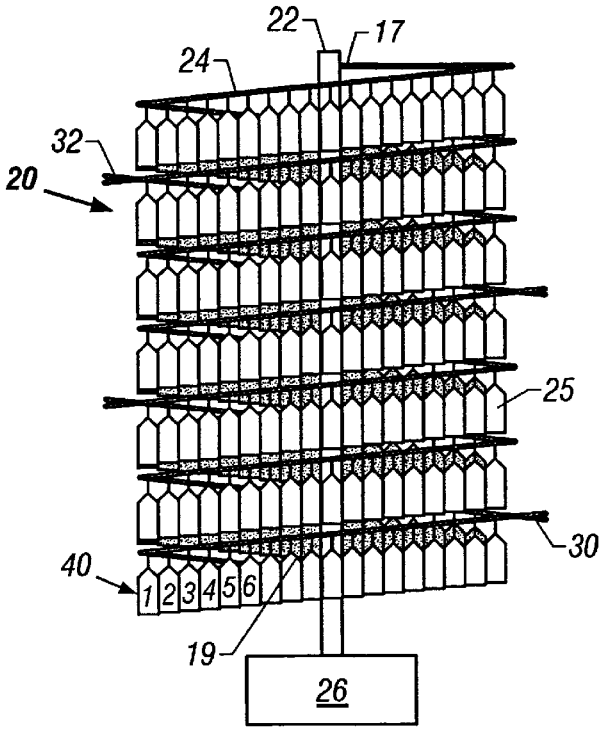
FIG. 1 is a side elevation of a storage and display rack according to an embodiment of the invention, the rack having a plurality of items suspended therefrom.

A first embodiment of the invention is shown in FIG. 1. This embodiment comprises a rack 20 having a base 26, a vertical mast 22, and a helical spiral track 24. The track 24 is mounted to and around the mast 22, which in turn is supported by the base 26. The base 26 may be any suitable support capable of supporting the vertical mast 22. If the rack 20 is to remain stationary, the base may, be an immobile stand similar in design to a simple Christmas tree stand. In alternate embodiments, the base 26 may be configured to allow the rack 20 to rotate in the manner of a spinner rack, allowing a person to rotate the rack until the desired item or product suspended from the track 24 comes into view. In still other embodiments, which are described below, the base 26 may be omitted entirely.

Figure 6A:
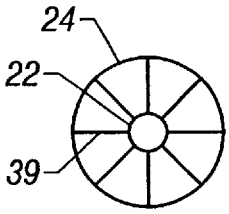
FIGS. 6A–6G are top views of various alternate track arrangements.
Figure 6B:
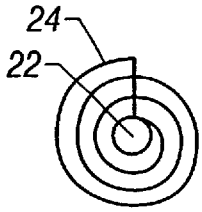
Figure 6C:
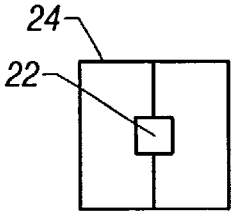
Figure 6D:
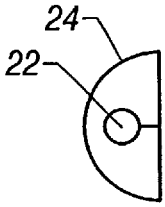
Figure 6E:
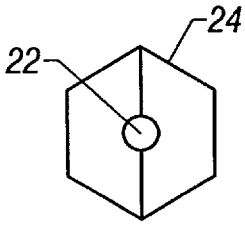
Figure 6F:
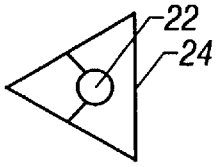
Figure 6G:
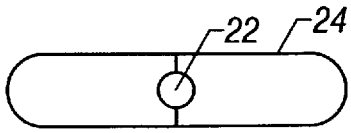
Figure 7A:
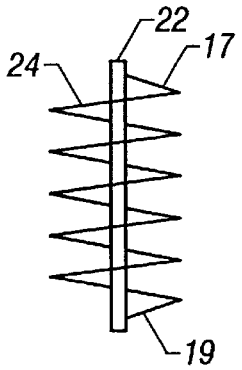
FIGS. 7A–7C are side elevations of various alternate methods of supporting a track employed in a rack according to the present invention.

In the embodiment shown in FIG. 1, the track 24 is formed of a rigid helical wire or cable. In this embodiment the track is sufficiently strong to be self-supporting. By providing a sufficiently rigid track, the track need only be attached to the mast at the top and bottom ends of the track as shown in FIG. 7A. However, depending upon the weight of the expected products, the stability required of the particular installation, and other factors, spoke-like supports 39 may extend from the mast 22 to the track 24 at selected locations to help support the weight of track 24 and the product 25 supported by the track (see FIG. 6A). Adding spoke-like supports 39 further performs the ancillary function of segregating portions of the track 24. This function will be described in more detail below.

Figure 2:
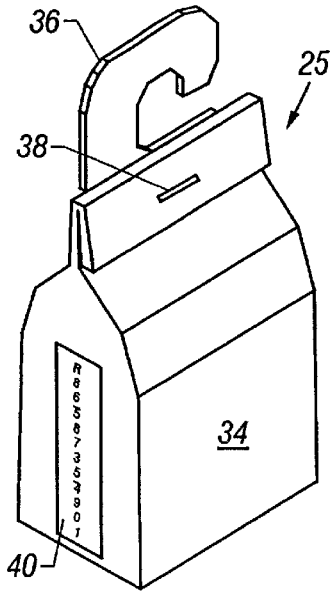
FIG. 2 is one example of a bag or container adapted to be suspended from the rack of FIG. 1.

Referring to both FIGS. 1 and 2, items 25 may be suspended from the track 24. In the embodiment shown, an item 25 is a small package 34 having a hook 36 adhered to the top thereof by means of a staple 38. Indicia, such as the code 40 shown in FIG. 3 identifying individual packages 25 are placed on the side of each package 25. The packages 25 may then be suspended from track 24 by means of the hook 36 with the identifying indicia facing outward so as to be easily read by a person standing adjacent the rack 20. The hooks allow the packages to slide along the track 24 in order to arrange packages as desired along the length of the track.

Figure 10:
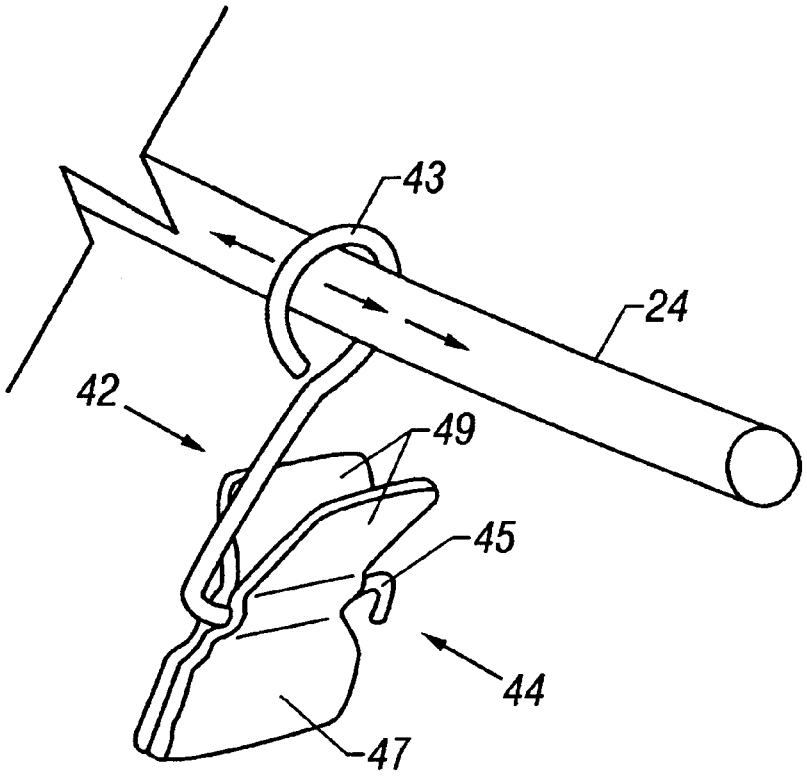
FIG. 10 perspective view of a fragment of track of an alternate embodiment of the invention wherein hooks are mounted to the track.
Figure 11:
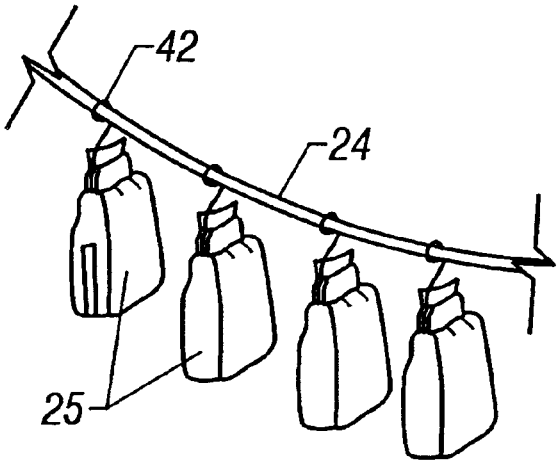
FIG. 11 is a perspective view of the fragment of track of FIG. 10 showing a plurality of items suspended from the hooks.

In an alternate embodiment shown in FIGS. 10 and 11, hooks 42 are slidably attached to the track 24 by means of a wire loop 43 substantially encircling the track. The hooks 42 include a lower portion 45 which supports an integrated clip 44. The integrated clip has a gripper portion 47 adapted to retain a portion of an item or container to be suspended from track 24. The clip is biased by means of a spring (not shown) and release wings 49, whereby the gripper portion of the clip may be opened to insert or remove an item supported by the clip 44. FIG. 11 shows a plurality of items 25 suspended from a plurality of hooks 42.

Figure 4:
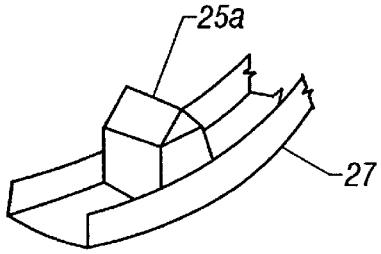
FIG. 4 is a fragment of a slide type track for use in an alternate embodiment of the invention.

Referring briefly to FIG. 4, an alternate track 27 is shown. Instead of being an overhead track from which packages are suspended, the track 27 comprises a slide on top of which packages or items 25*a* are supported. The slide 27 may be formed having any of the desirable shapes and features of the overhead track 24 which are described below. Obviously, when a slide 27 is provided, the packages or items supported by the rack will not require a hook. Therefore, in FIG. 4 an alternate package 25*a* is shown supported by a short section of slide 27.

Returning now to the embodiment of FIG. 1, the helical shaped track 24 curves around the mast in a downward spiral forming a number of successive tiers or levels. Thus, at any given angle relative to the rack 20, a plurality of levels of the track are presented to an individual facing the rack. The, track 24 depicted in FIG. 1 has the form of a continuous, gently sloping downward spiral; however, the shape of the track may take any suitable form necessary to meet the demands of a particular application.

Figure 5A:
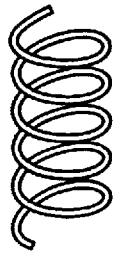
FIGS. 5A–5F are variations of spiral tracks that may be used in various embodiments of the invention.
Figure 5B:
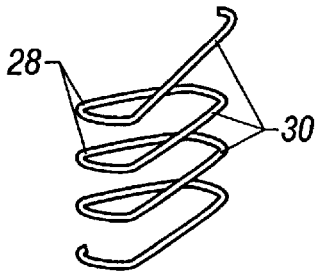
Figure 5C:
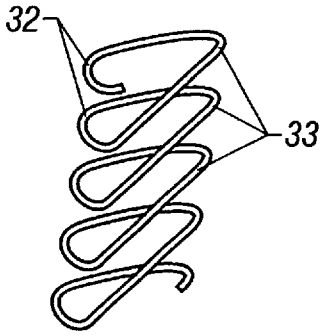
Figure 5D:
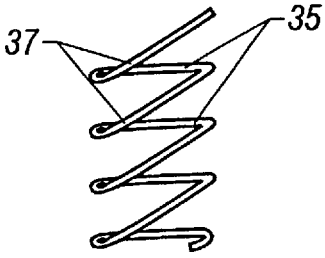
Figure 5E:
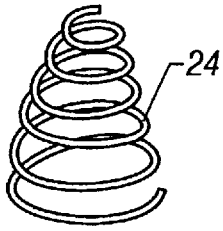
Figure 5F:
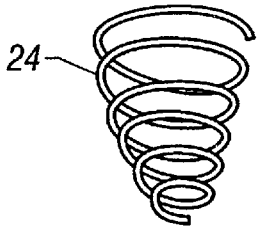

FIGS. 5A–5F show a number of different track arrangements suitable for different applications. FIG. 5A shows a track 24 in the shape of a simple circular spiral. FIG. 5B shows a track 24 in the form of a modified spiral having a series of horizontal landings 28. The landings are connected by angled portions of the track 30 extending between levels. FIG. 5C is similar, showing a half-spiral with semicircular landings 32 and flat angled portions 33 extending between the landings. FIG. 5D shows yet another variant of the basic spiral. The track 24 shown in FIG. 5D comprises a flat staircase having horizontal landings 35 on one side, and angled risers 37 between landings on the other side. Other variations of spirals may also be used, such as the descending conical spiral track 24 shown in FIG. 5E or the ascending conical spiral track 24 shown in FIG. 5F. A common feature of these different tracks is that they are continuous, and that the different levels or tiers are interconnected so that products can be moved along the track from one tier to another without the necessity of removing the products from the rack.

In addition to variations of the spiral character of the track 24, including the various landings and angled portions and such, the shape of the helical track may take on a number of different forms, when viewed from above. For example, FIGS. 6A–6G show a non-exclusive collection of possible shapes for the helical track 24. Many of the shapes shown in FIGS. 6A–6G correspond to the various track embodiments in FIGS. 5A–5F. The shapes disclosed in FIGS. 6A–6G comprise respectively: a circular helical track 6A having spoke-like supports 39. extending from the central mast 22; an ascending or descending spiral 6B; a square 6C; a semi-circle 6D; a multi-sided polygon 6E; a triangle 6F; and an oblong or oval track 6G.

Figure 7B:
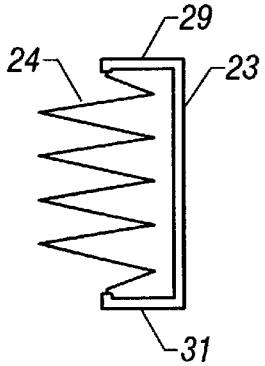
Figure 7C:
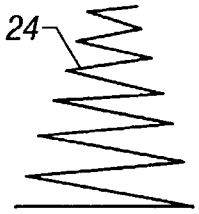

Various mounting arrangements for the track 24 are shown in FIGS. 7A, 7B and 7C. The mounting arrangement shown in FIG. 7A corresponds to the embodiment of FIG. 1 wherein the vertical mast supports the upper end 17 and lower end 19 of the track 24. In the embodiment of FIG. 5B, the vertical mast is replaced with a "C" shaped vertical support 23. Track 24 is connected to the upper and lower horizontal arms 29, 31 of the "C" shaped vertical support at each end of the helical coil. FIG. 7C shows another embodiment comprising merely a rigid helical track wherein both the mast and the base are omitted. In this version, the rigid track 24 sits directly on a floor or shelf or some other support surface. In this embodiment, the track must be sufficiently strong to support its own weight and the weight of the items to be suspended from the track.

Figure 8A:
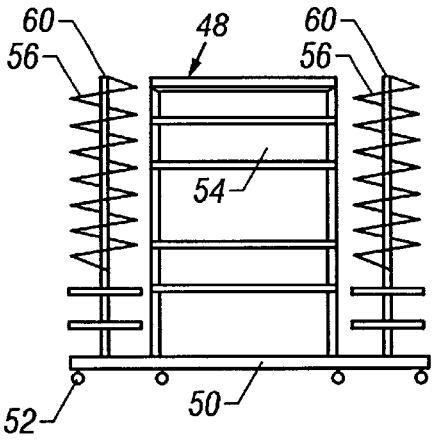
FIGS. 8A and 8B are front elevations of rolling carts having racks mounted thereon according to embodiments of the invention.
Figure 8B:
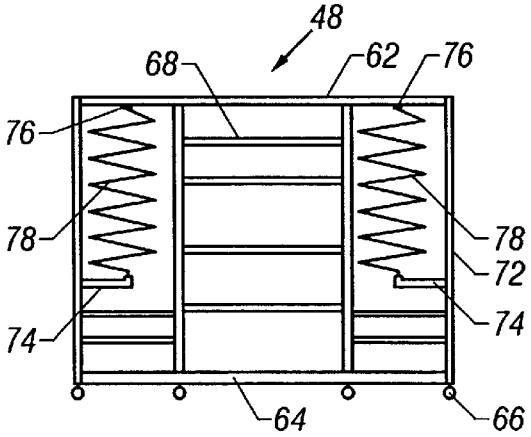

In addition to floor-mounted or shelf-mounted racks, a rack or racks according to the present invention may also be provided on rolling carts 48 as shown in FIGS. 8A and 8B. Mounting racks according to the present invention on movable carts offer mobility and additional shelving and storage space. Such carts include a substantially flat planar base 50, 64 supported by a plurality of casters 52, 66. Cabinets or shelves 54, 68 are mounted above the base 50, 64 and provide additional product storage. Turning first to the embodiment shown in FIG. 8A, vertical masts 60 are mounted on the planar base 50, and helical tracks 56 as have been described are mounted to the masts 60. The embodiment of FIG. 8B is substantially the same as that shown in FIG. 8A, except that the vertical masts 60 have been removed. External cabinetry including side walls 72 is provided, and top 62 extends over most of the base 64 with the ends of the helical tracks 78 supported by the cabinet top 62 at posts 76 and brackets 74 extending from the side walls 72.

Figure 9:
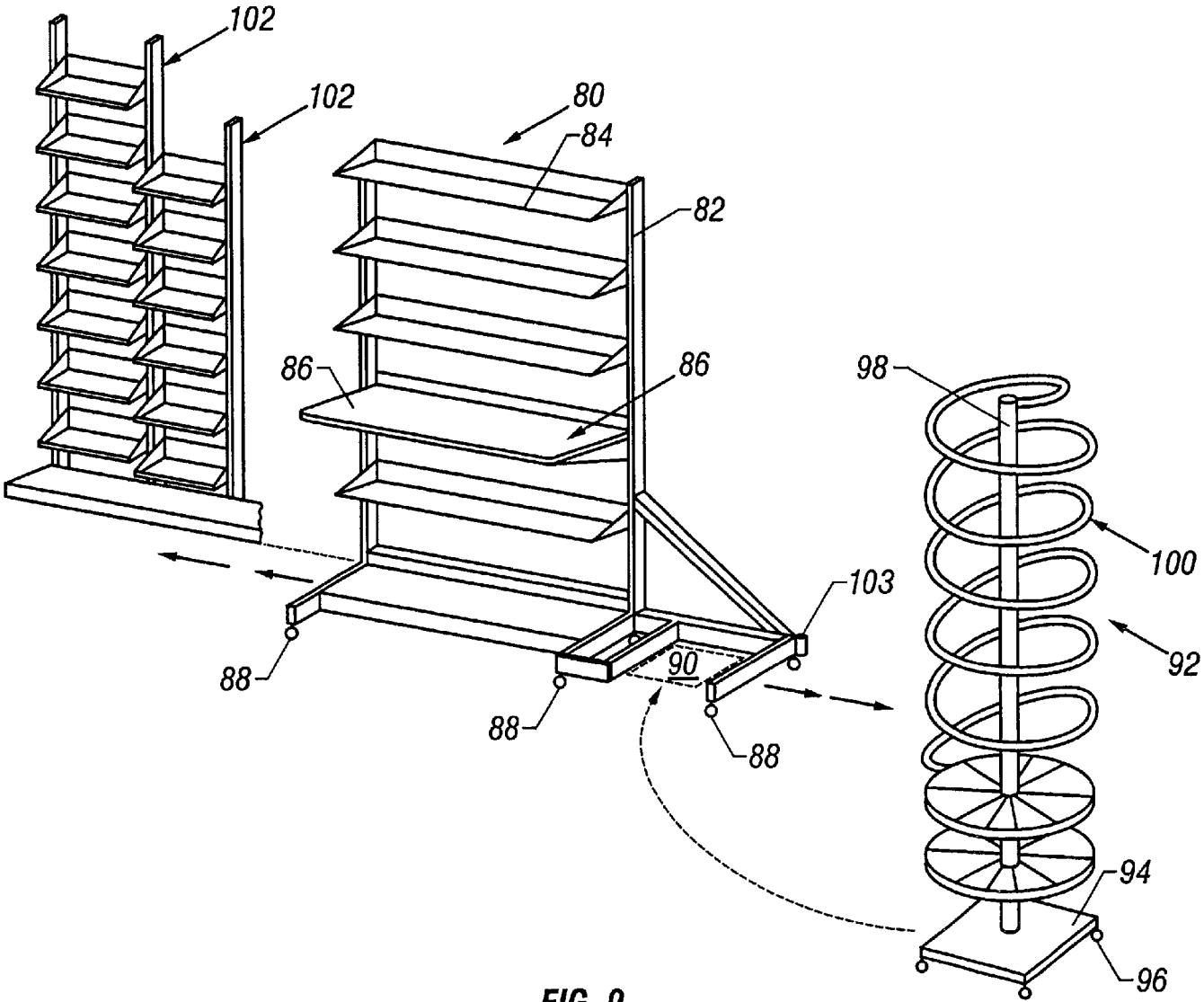
FIG. 9 is a perspective view of a rack system according to the present invention particularly well-adapted for use in a pharmacy.

Yet another embodiment, of a rolling cart particularly well-adapted for the pharmacy setting is shown in FIG. 9. There the mobile cart 80 comprises a frame 82, which supports a series of shelves 84 and a work top or area 86. The cart 80 is itself supported on casters 88. A cove or bay 90 is formed by the frame 82 to receive a portable prescription refill rack 92. The rack 92 has a base 94 supported by casters 96 and a center mast 98. A spiral track 100 is supported by mast 98. The rack 92 is sized and shaped to removably fit within cove 90, where, if desired, it can be temporarily locked in place. When positioned within cove 90, rack 92 can be moved with mobile cart 80 as one unit. The cart 80 is designed to be moved along shelving 102 in the pharmacy, where medications are stored for the preparation and filling of patient prescriptions. Rollers 103 are provided along the lower back of frame 82 to space the frame away from shelving 102 as the cart 80 is moved so as not to damage the shelving.

As the pharmacist or technician may require, the cart 80 provides a work station for preparing prescriptions which can be moved along the shelving 102 to obtain the desired medications. As each prescription is prepared, it is placed in an appropriate container, such as bag 34 (FIG. 2), labeled with an appropriate patient identifier 40 (FIG. 3), and placed in the appropriate location or segment on track 100 for holding until picked up, perhaps several days later, by the patient. Once the rack 92 is full, it can be removed from cart 80 and temporarily stored at another location in the pharmacy convenient for access when patients arrive for their prescriptions. Another empty rack can then be substituted for rack 92 in cove 90, and the prescription-filling process repeated. This embodiment thus provides a unique method and system for efficiently preparing prescription refills several days or more in advance of when they will be needed and storing them in an ordered inventory system so that the prescriptions can be readily identified and delivered when patients arrive to pick them up.

Figure 3:
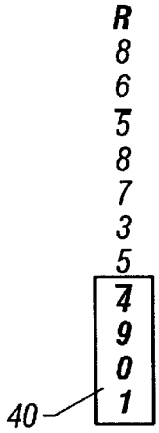
FIG. 3 is an example of a code that may be applied to a bag or container such as that shown in FIG. 2.

The use of a rack 20 according to the embodiment of FIGS. 1–3 in an inventory control system will now be described. It should be noted that racks made according to other embodiments may function equally as well, and in the same manner as the embodiment now described; however, for the sake of brevity, the functional description of the rack will be limited to this one embodiment. The application described below is similarly restricted to use of a rack 20 in a pharmacy setting wherein the items to be stored and inventoried on the rack are prefilled prescription orders. However, the present invention is in no way limited to this particular application, and racks 20 may be readily adapted to other applications such as inventorying commercially processed film orders, medical records and the like.

According to the inventory control and storage system of the present invention, a pharmacist will prepare prescription drug orders in advance of the customer's arrival at the store. Upon completing the order, the pharmacist will package the order in a bag or cardboard container, or some other package 25 as depicted in FIG. 2. The pharmacist will then write, or otherwise affix an identifying label 40 to the package 25. The identifying label may comprise the patient's name or a numerical code such as that shown in FIG. 3, or some other identifying indicia. Upon placing the order in the container and sealing the container, the pharmacist then suspends the package 25 from the track 24. In the preferred embodiment, the bags slide under gravity to the bottom of the spiral track. As more packages are added they form an array of packages extending upward along the track. As individual bags are removed to present to customers, the rest of the packages within the array slide down to fill the gap.

The pharmacist continues this process, suspending additional packages from the track and periodically removing packages to present to customers. Each additional package suspended from the rack is placed on the rack in a sequence dictated by the identifying indicia on the side of the package. For example, the packages may be placed in numerical order according to the code 40, or if the indicia on the side of the package is the patient's name, the packages can be placed on the rack in alphabetical order. Due to the novel design of rack 20, the packages 25 may be placed on track 24 in sequence regardless of the order in which they are prepared. As packages are hung on the track which bear indicia which sequentially fall between the indicia marked on packages previously hung on the track, the previously hung packages may be slid either further up or further down the track to make room for the additional packages. Thus, the general sequence of packages, i.e. numerical or alphabetical, may be maintained without undue reorganization of the previously prepared packages.

Similarly, if the pharmacist is interrupted from preparing prescriptions and must remove one or more packages from the track to present to a customer, the proper package may be quickly identified by following the sequence of indicia applied to the sides of the packages. The properly identified package 125 may then be removed from the track without disrupting the overall sequence of packages that remain.

An additional feature of the present invention is that the track may be segregated into sections. For example, each tier or level of track 24 could be designated as carrying a group of a limited number of packages, with the first tier carrying packages having a code number ending in the numbers 1–10, the second tier carrying packages 10–20, and so on. Another alternative for segregating portions of the track 24 is to apply dividers 30, 32 (see FIG. 1) in the form of clips to the track as, shown in FIG. 1. The dividers then separate the track into smaller segments in order to facilitate locating the proper sequential location for particular packages. For example, a first divider may be designated 1–20, and all packages having codes ending in the numbers 1–20 may be placed on the track 24 above the divider labeled 1–20. Similarly, the next divider may be designated 21–40, and all packages having code numbers 21–40 may be placed on the track 24 between the dividers labeled 21–40 and 1–20. If spoke-like structures are used to help support the track 24, these structures may also be used for purposes of segregating packages.

The advantage of the removable clips 30, 32 is that the user may move the clips as his needs change in order to segregate product according to his instant needs to permit bookmarking. The advantage of the spoke support is that heavier products may be supported on the track. Another advantage of the segregation by clip or spoke is that the rack may maintain a better balance, especially in cases where the rack is designed to rotate, as in a spinner rack. If a number of products should slide to the same side of the rack, the rack may become unbalanced. To remedy this situation, the user may slide a selected number of products back to an opposite side of the rack to rebalance the rack and then hold them there by placing clips 30, 32 on the track 24.

As has been described, in applications other than in a pharmacy, the product or item 25 (FIG. 2) may take any convenient form. In the case of processed photographs or medical records, the items may be in the form of hanging envelopes or folders. In the case of prescription refills, the bag 34 is similar to those in common use, with the hang hook 36 stapled thereto at 38.

Those who are skilled in the art will readily perceive many modifications which fall within the scope and spirit of the invention. Therefore, the appended claims are to be construed to include all equivalent structures.

The claimed invention is:

1. A rack for storing or displaying a first plurality of items, said rack comprising:

a support; and a track for supporting the first plurality of items, the track being secured to the support and forming a plurality of interconnected levels joined in a generally descending manner;

wherein the support includes an area separate from the track for storage or display of a second plurality of items.

2. A system for storing or displaying a plurality of items comprising:

a support;

a track secured to the support and having a plurality of interconnected levels; and means for supporting the items on the track, whereby the items may move along the track between the different levels;

wherein the means for supporting the items on the track comprise clips adapted to be secured to the track and to removably grasp the items.

3. The system of claim 2 further comprising a container for receiving the items and adapted for being removably grasped by the clip.

4. The system of claim 3 further comprising a label on the exterior of the container.

5. The system of claim 2 wherein the clip further comprises a hook to engage the track.

6. A system for storing or displaying a plurality of items comprising:

a support;

a track secured to the support and having a plurality of interconnected levels; and means for supporting the items on the track, whereby the items may move along the track between the different levels;

wherein the means for supporting the items on the track comprises a plurality of containers to hold the items, each container being adapted to be supported by the track and comprising a hook for engaging the track.

7. A method for inventorying a plurality of unique items comprising the steps of:

individually identifying and labeling each item with a unique identifier;

providing a track having a plurality of interconnected levels; and supporting the items on the track in a predetermined order based on the unique identifier, whereby the items move along the track to form a substantially continuous array.

8. The method of claim 7 further comprising the step of periodically removing particular individual items from the plurality of items supported by the track, the remaining items on the track within the array being movable to fill gaps within the array created when the particular items are removed.

9. The method of claim 8 further comprising the step of dividing the track into a plurality of segments and segregating the items into groups within the track segments based on a characteristic of the unique identifiers.

10. A rack with filing capabilities, said rack comprising:

a vertical mast having an upper and a lower end;

a track in the form of a helical spiral having a top and a bottom attached between said upper and lower ends of said mast;

a container for holding a product, said container including means for supporting said container on said spiral track; and a label on a side of said container, which label is exposed to view when said container is supported on said track.

11. The rack of claim 10 wherein said track is adapted to rotate.

12. The rack of claim 10 wherein said container support means is a hook which enables the container to slide down said helical track.

13. The rack of claim 12 and means for segregating said track into segments, whereby containers supported by the track above the segregating means slide down said track only as far as said segregating means.

14. The rack of claim 10 wherein said helical spiral defines successive tiers extending downwardly.

15. The rack of claim 10 wherein said containers hold medications and said labels identify at least the medication in said container.

16. The rack of claim 10 wherein said containers hold medications and said labels identify a patient.

17. A method of storing prescription medicines, said method comprising:

providing containers;

pre-filling individual said containers with prescription medicines in anticipation of patients' needs for said prescription medicines;

providing a track having a plurality of interconnected levels;

placing labels on said containers, said labels including identifiers associating said containers with a patient and whereby said containers may be placed on said track in a sequential order; and placing said containers on the track in a sequential order.

18. The method of claim 17 wherein said labels identify the medicines in said containers.

19. The method of claim 17 wherein the track rotates to expose all of said containers to view.

20. The method of claim 17 wherein said containers include a hook for suspending the containers from the track, and said track and hook are configured so that said containers slide down said track to fill a gap between adjacent containers created when one of said containers is removed from said track.

21. The method of claim 17 wherein said track is a slide and said containers sit on said slide.

22. A rack for storing medications, said rack comprising:

a track having a plurality of interconnecting levels;

a plurality of containers adapted to be supported by and move along said track, said containers having identifying labels thereon which are exposed to view, whereby said containers are stored in an ordered system; and means for enabling said rack to rotate and expose said labels to view regardless of where they are on said rack.

23. A rack for storing medications, said rack comprising:

a track having a plurality of interconnecting levels;

a plurality of containers adapted to be supported by and move along said track, said containers having identifying labels thereon which are exposed to view, whereby said containers are stored in an ordered system; and wherein each of said containers has a hook and said track is configured to receive said hook.

24. A system for creating an ordered inventory of unique of items comprising:

a mobile cart;

a track associated with the mobile cart, said track defining a plurality of interconnected levels;

means for supporting the items on the track, whereby the items may move between different levels along the track; and indicia associated with each item whereby said items may be placed on the track in an ordered manner.

25. The system of claim 24 wherein said track is removably associated with said mobile cart.

26. The system of claim 25 further comprising locking means for temporarily securing said track to said mobile cart.

27. The system of claim 24 further comprising a plurality of shelves for storing said items prior to said items being placed on the track.

28. The system of claim 24 wherein the track is rotatably mounted to said cart.

29. The system of claim 24 wherein the items are supported by the track in a sequential arrangement according to the indicia on each item.

30. The system of claim 24 further comprising a shelving unit, said cart being equipped with means for maintaining a predetermined spacing between the cart and the shelving unit as the cart is moved transversely along the shelving unit.

31. The system of claim 30 wherein the cart has a rear side and said spacing means comprises rollers disposed along said rear side.

* * * * *